United States Patent [19]

Jones

[11] Patent Number: 4,647,090

[45] Date of Patent: Mar. 3, 1987

[54] SAV-A-LIFE LATCH-RELEASE WINDOW GUARD LATCH-RELEASE

[76] Inventor: Cleao O. Jones, 2125 Lorenzo La., Sacramento, Calif. 95824

[21] Appl. No.: 635,731

[22] Filed: Jul. 30, 1984

[51] Int. Cl.[4] ..... E05C 1/06

[52] U.S. Cl. ..... 292/161; 292/DIG. 65; 292/DIG. 66

[58] Field of Search ..... 292/DIG. 66, 177, 186, 292/184, 171, 141, 139, 167, 178–182, 1

[56] References Cited

U.S. PATENT DOCUMENTS

| | | | |
|---|---|---|---|
| 910,815 | 1/1909 | Hendrick | 292/184 |
| 985,142 | 2/1911 | Carter | 292/184 X |
| 3,843,176 | 10/1974 | Gonzalez-Cuyan | 292/218 |
| 3,953,064 | 4/1976 | McHenry | 292/184 |
| 4,111,477 | 9/1978 | Rigoli | 292/252 |
| 4,311,329 | 1/1982 | Kral | 292/DIG. 66 X |

*Primary Examiner*—Richard E. Moore

[57] ABSTRACT

A window guard is hinged to a wall member and is releasably secured thereto by a latch means which interconnects the wall member and the window guard and is operated by a cable which extends to a weighted member held by a low melting point link. When the link melts or the cable is pulled the weighted member drops to release the latch means. Also, a drop latch is guided in a stile of the window guard and detent means operable from an opposite side of the wall member releases the drop latch from latching engagement with latch catch means on the wall member.

9 Claims, 5 Drawing Figures

FIG I

SAV-A-LIFE LATCH-RELEASE WINDOW GUARD LATCH-RELEASE

This invention relates to a latch-release mechanism fitted and welded to a typical ornamental steel window guard. The guard is hinged and upon actuation of the mechanism becomes openable.

OBJECT OF INVENTION

Accordingly several objects of my invention are to provide a safe, quick to open steel window guard to allow occupants to escape or be rescued in case of fire.

Another object of said invention is a latch-release not dependent on electric wiring or batteries.

Another object of said invention is a latch-release to provide an easy to pull hand trip from inside a dwelling.

Another object is to provide an automatic release controlled with a fire door link.

Another object is to provide an outside lock for the owner, for security, or for accessability by fireman.

Further objects and advantages of my invention will become apparent from a consideration of the drawings and ensuing description thereof.

DESCRIPTION OF INVENTION

Figure 1:
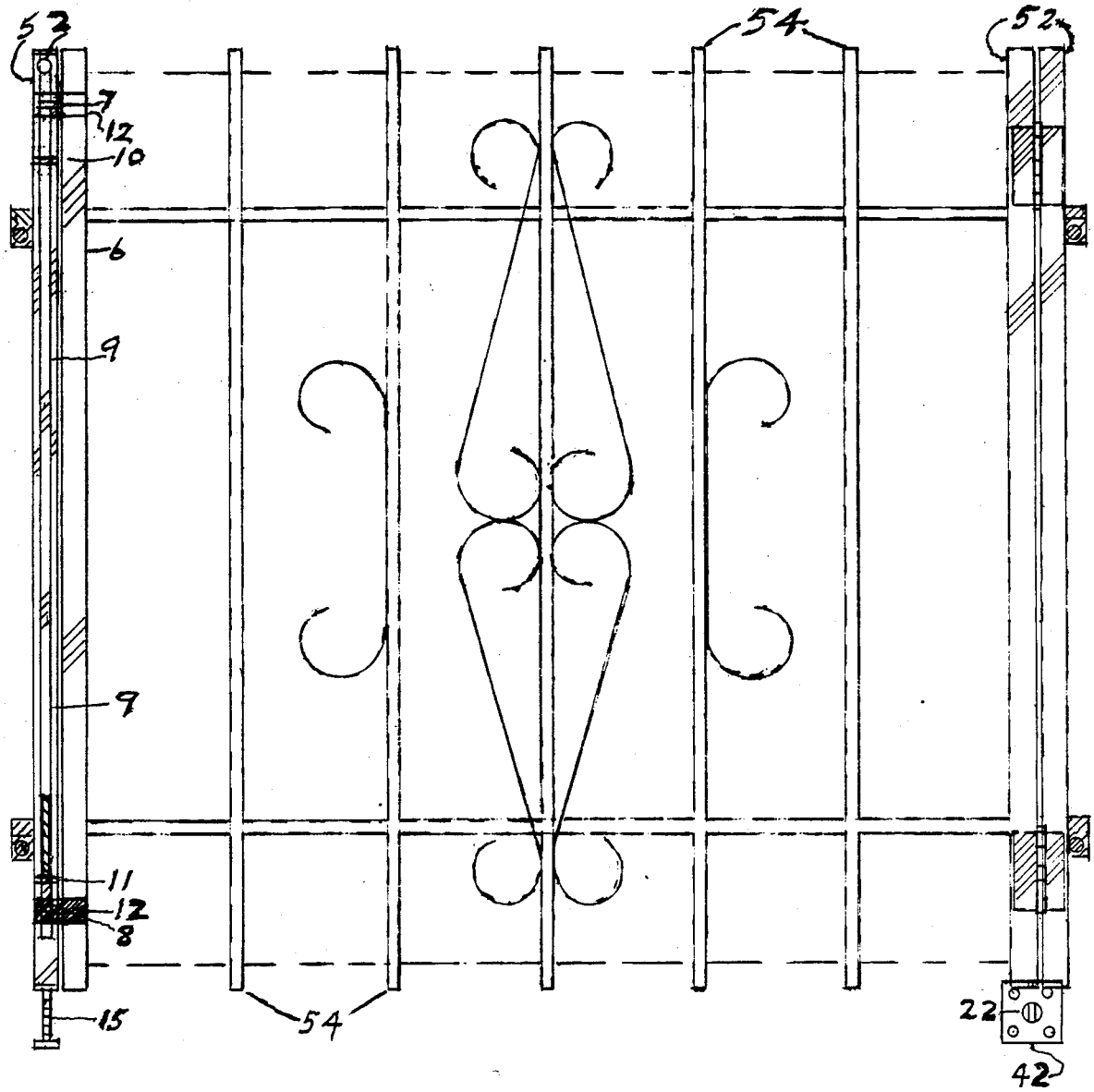
FIG. 1 is the exterior elevation of my invention showing the latch-release, stiles 5 and 6, latch 9, end of copper tubing 2 inserted in back of stile 5, reset key 15, outside lock mechanism 22 and phantom ornamental steel window guard 52 and 54.

Referring to FIG. 1 of my invention, a latch-release is designed to adapt to any typical ornamental steel window guard. The stiles 5 and 6, steel tubing, are cut to the same length as the height of the window guard used. The window guard is welded to stile 6. Stile 5 has brackets welded on the outside, designed to use one way lag screws 28, for mounting on the exterior wall.

Figure 2:
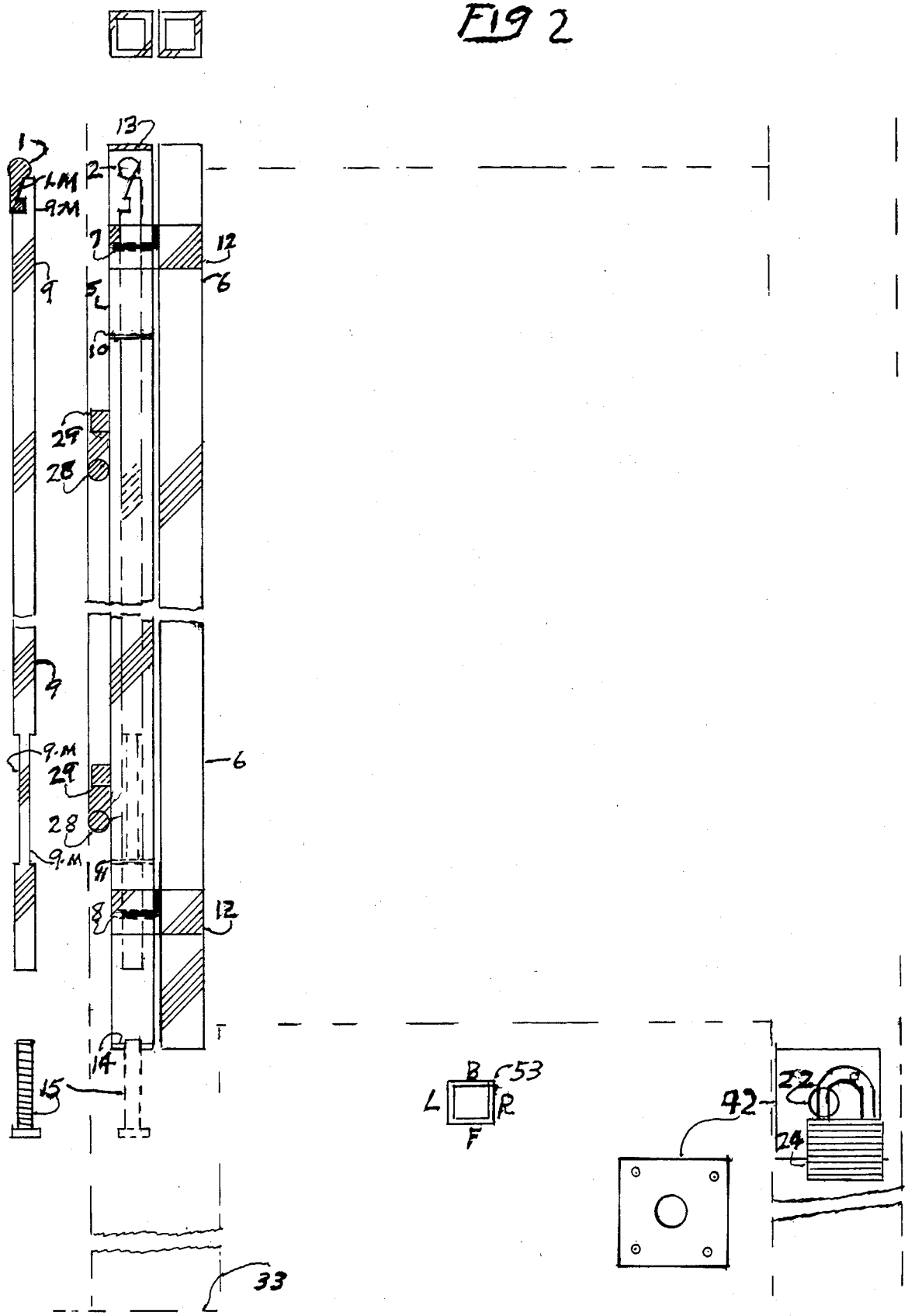
FIG. 2 is the enlarged section of the latch-release showing the end view of trip rod 1 with machined shape 1-M and 9-M—9-M on drop latch 9. The location of drop latch guides 10 and 11, catches 7 and 8, reset key 15, outside lock mechanism 22 for use of phantom padlock 24.

Referring to FIG. 2, trip rod 1 and drop latch 9 are machined to mesh as shown at top of drawing. This Figure also shows end of copper tubing 2 inserted in back of stile 5, drop latch 9 machined at 9-M on both sides to receive guide 11. Stile 5 is cut through from front to back full width on inside of stile for guides 10 and 11. Stile 5 is cut out for latch catches 7 and 8, cut F&R (front and right) which removes the corner of F&R to receive latch catches 7 and 8. Machine guide 10 with a center hole, loose fit for drop latch 9 and insert through stile 5. Machine guide 11 to loose fit on drop latch 9 at M. Insert drop latch 9 through guide 10 with M side of top 9 facing left, insert guide 11 through stile 5 with drop latch 9-M in slot of guide 11. Drop latch 9 should move freely up and down. Weld guides 10 and 11 on ends where same shows on outside of stile 5. Drop latch 9 when completely down the top of drop latch should be below cut out of latch catch 7. Latch catches 7 and 8 should then be shaped, see FIG. 3, weld to stile 6 to freely slip into slot of catches 7 and 8. Weld latch cover 12 on stile 6 to cover latch catches 7 and 8.

Drill a hole, to size of copper tube 2, through exterior wall of a building to correspond with hole drilled in back side of stile 5. Insert copper tube 2 through wall and install spacers 3 and 4, galvanized pipe over end of copper tube (see FIG. 3). Install trip rod 1 through copper tube 2 into hole in stile 5 then fasten to exterior wall.

Figure 3:
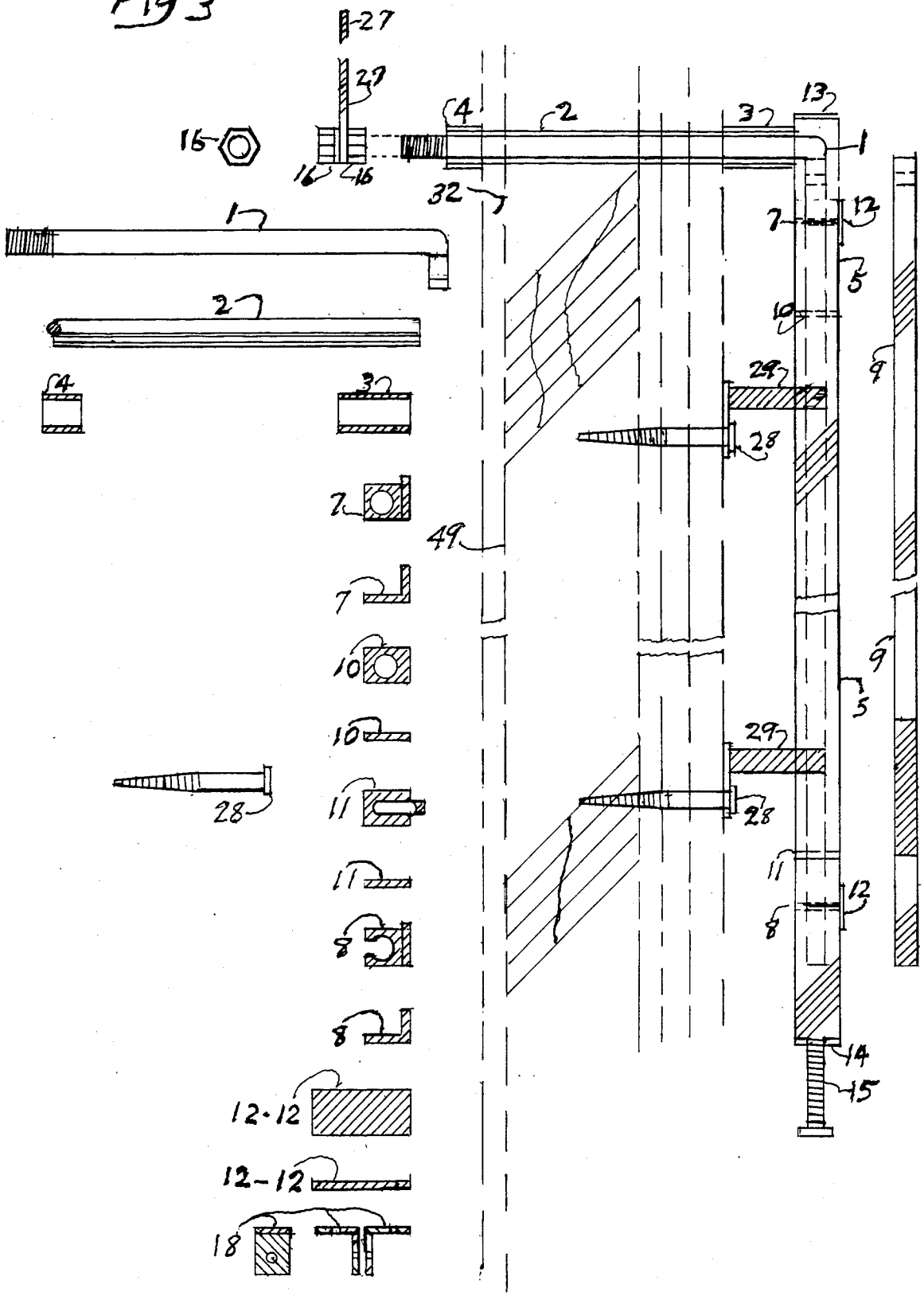
FIG. 3 is the cross section of the latch-release through the wall to the interior with trip rod 1 and drop latch 9. Also including component parts.

Referring to FIG. 3, this is the latch side of the window through the wall which shows assembled parts of the invention on the exterior wall.

Figure 4:
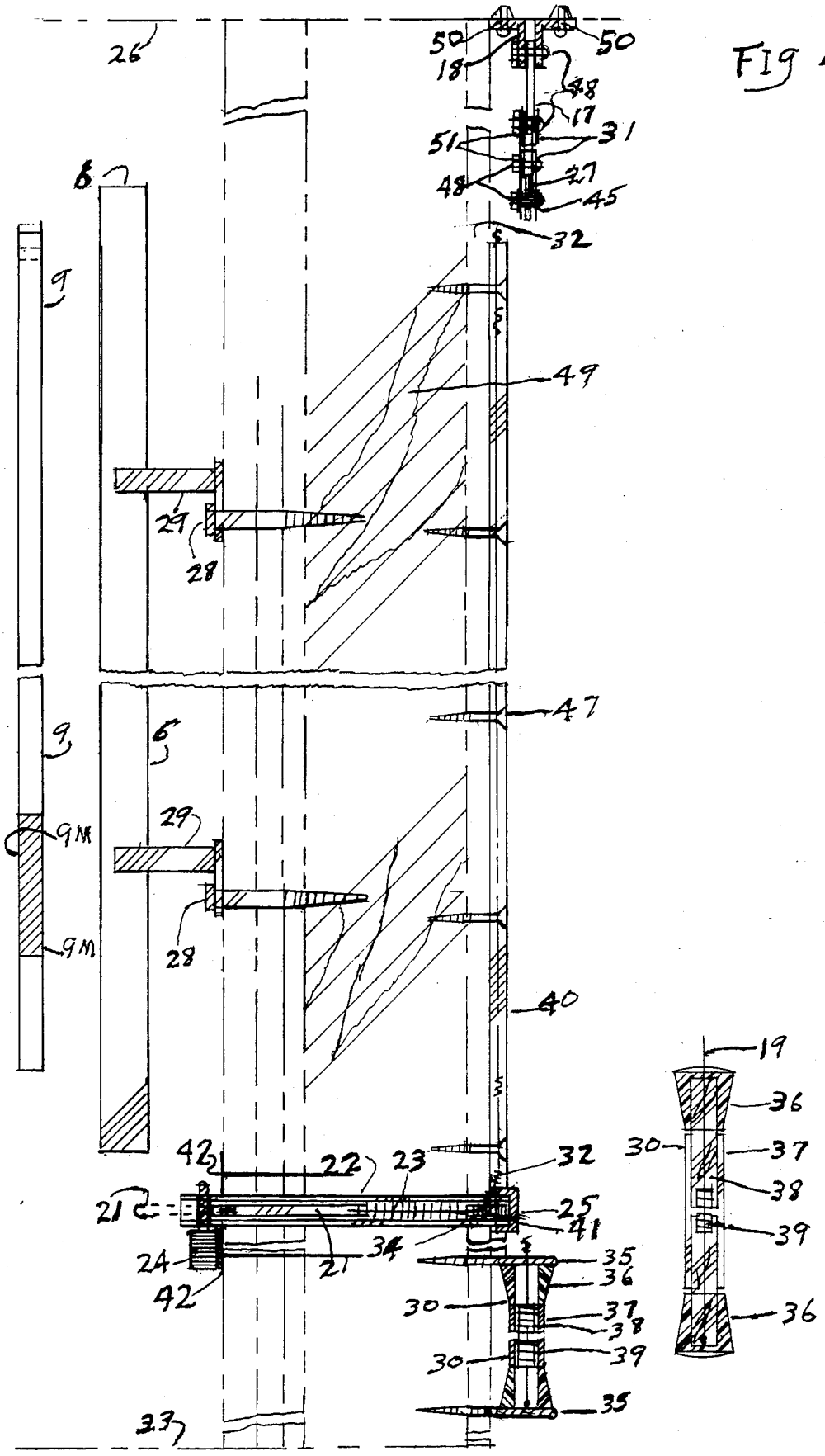
FIG. 4 shows the opposite elevation, the control section 51, hand trip 30, exterior lock mechanism 22 and fire door link 17 locations.

Referring to FIG. 4, this is the opposite side through the wall on hinged side showing the control center 51 installed on the ceiling; also fire door link and control arm rest. The interior cable and handle trip 30, the exterior lock mechanism 22 and release through the wall. Phantom padlock 24 shown but not included.

Figure 5:
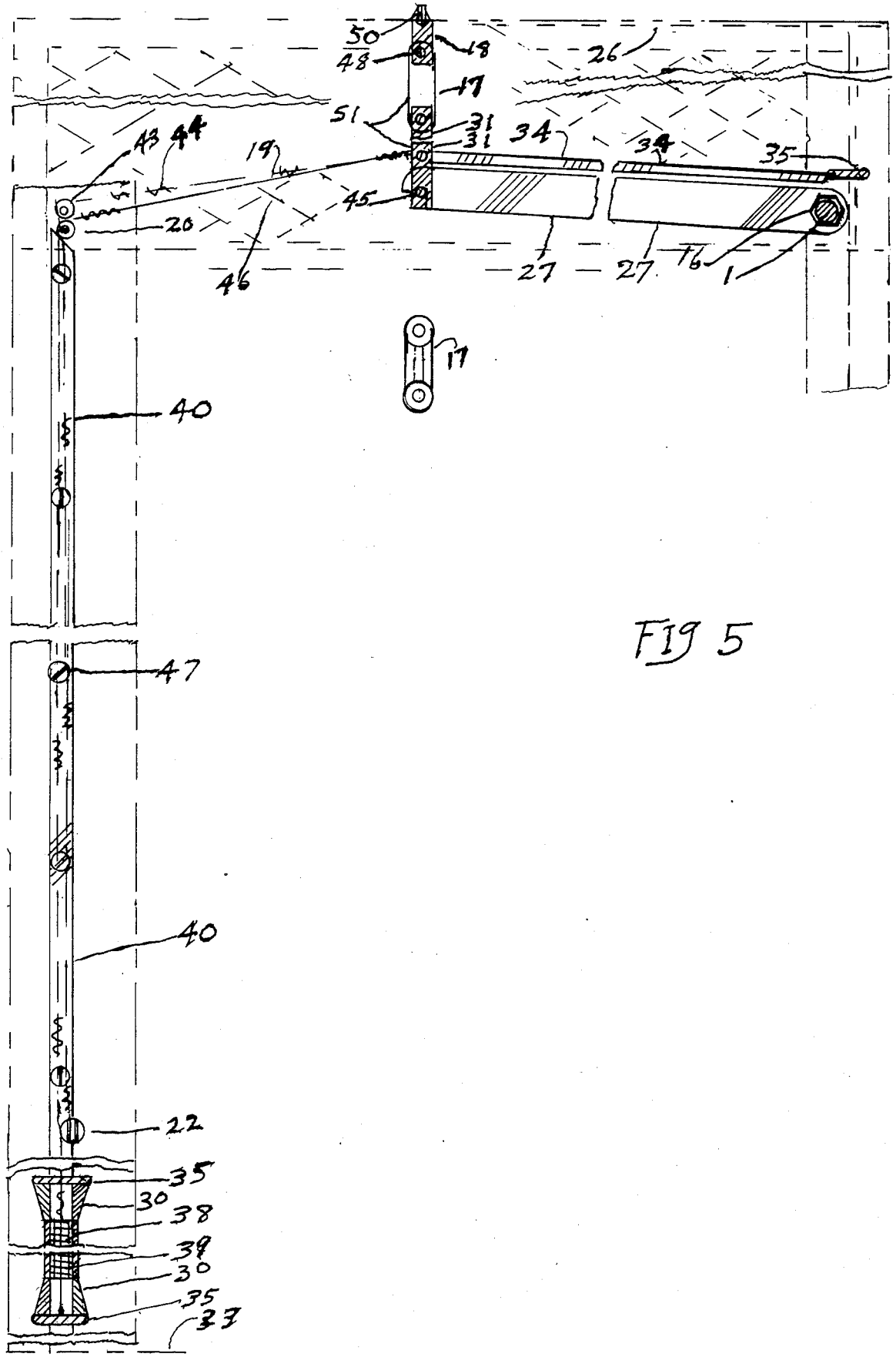
FIG. 5 shows the interior latch-release control section 51, control arm 27, tension spring 34, inside hand trip cable 19, out side hand trip pull 30, fire door link 17 and cable cover 40. Expanded metal or screening 46 to cover latch control area 51, for cosmetic purposes and is optional.

Referring to FIG. 5, the inside elevation shows control center 51 installed on the ceiling which supports fire door link 17, tension spring 34—34, screw eye 35. End of control arm 27—27 which fits on end of trip rod 1, control arm rest 45, and cables 19 and 44 that are covered by 40. Hand trip pull 30 is numbered (see FIG. 4). Expanded metal or screen 46 to cover latch control area, for cosmetic purposes, and is optional.

OPERATION

The exterior latch catch section of my invention is square steel stiles 5 and 6. Stile 5 has two cut outs 7 and 8, front and right, wide enough to receive latch catches 7 and 8. These catches are welded on stile 6 on the left side to match cut outs in stile 5.

Stile 5 contains the drop latch 9 which has been machined on top to receive trip rod 1 which has been machined to form a hook type shape to mesh with drop latch 9. Drop latch 9 has two guides 10 and 11 on the inside of stile 5. The top guide 10 is for alignment. The bottom guide 11 is a "U" shape to fit the 9-M and 9-M of drop latch 9 to keep it from turning and also alignment. The top catch 7 has a hole to fit drop latch 9. The bottom latch catch 8 has a "C" shape that fits around drop latch 9 when in a closed position, also top catch 7 by-passes the top end of drop latch 9. The bottom latch catch 8, "C" shaped, slides over drop latch 9 at the cut outs in stile 5.

With the openable section of the steel window guard closed, screw in the reset key 15 which raises the drop latch 9 to lock catches 7 and 8, this raises drop latch 9 in position to hook trip rod 1. Trip rod 1 extends through the wall, through a copper tube 2, of which a hole is drilled through the wall to fit. The copper tube 2 extends into stile 5 to the control arm 27 which has been pre-shaped with a seat on the top end and a hole the size of trip 1 on the bottom end. Install a nut 16 on end of trip rod 1 then the control arm 27 then another nut with washer 16.

The control center 51 is fastened to the ceiling with Molly (T.M.) bolts 50 and brackets 18. Onto these brackets is fire door link 17 with 135 degrees fire heat melting point. The straps 31 on each side secure the location for tension spring 34 which fastens to screw eye 35. Trip cable 19 is concealed by cover 40 to near the floor completing a hand trip pull 30. Cable 44 extends from control center 51 to pully 20 through cable cover 40 to just below bottom of steel window guard then through exterior wall. Full the outside trip latch 21 to trip lock 22. Outside lock 22 is a galvanized pipe.

To complete a closed and locked position of the latch-release equipped window guard close the openable section and hold closed while turning the threaded reset key 15 up tight in the bottom of stile 5. This raises drop latch 9 to a locked position. On the inside raise control arm 27 to control arm rest 45, at the bottom end of control center 51, this forces trip rod 1 to mesh with drop latch 9, completing the locking together of stile 5 and stile 6 of window guard. Remove key 15 store in a safe place.

For opening the latch-release equipped window guard by hand from the inside remove the inside hand trip 30 from screw eye holder 35 and give a light pull, this releases control arm 27 from control arm rest 45 letting the control arm drop. This turns trip rod 1 allowing trip latch 9 to drop releasing stile 5 from stile 6.

For opening of latch-release equipped window guard from the exterior lock 22, remove phantom padlock 24, coil spring 23 forces outside trip handle 21 out of end of pipe. Pull outside trip handle 21 until drop latch 9 will fall to release window guard.

For opening of latch-release equipped window guard with fire loor link 17 which is installed in control center 51. The fire door link melts at 135 degrees fire heat releasing control center 51. Control arm 27 drops, this turns trip rod 1 releasing drop latch 9, releasing stile 5 from stile 6.

There are many additions and substitutes that can be used in lieu of the above, for example if the ceiling is too high for hanging of the control center a shelf type bracket can be installed on the wall. The hand trip pull could be a variety of shapes or sizes. The one I used and designed gives a semblance of not being a pendulum.

I claim:

1. A window guard latch release mechanism comprising a weighted member held by a low melting point link for release under high heat conditions to unlatch a window guard from latched condition or by cable means connected at one end to said weighted member and at the other end to a latch means interconnecting a wall member and a part of a window guard, said latch means including release means connected to said cable means for releasing said latch means; and a drop latch movably connected to another part of said window guard and including means releasably interconnecting said window guard and said wall member, and a detent means movably secured relative to said window guard for holding said drop latch in latching position with said interconnecting means, said detent means including handle means for operating said detent means, to release said drop latch, located on an opposite side of said wall member.

2. The structure of claim 1 wherein said window guard is hinged to said wall member.

3. The structure of claim 1 wherein said drop latch is contained in a vertically-oriented stile of said window guard.

4. The structure of claim 3 wherein said interconnecting means comprising at least one latch catch extending from said wall member through opening means in said stile and is connectable with said drop latch.

5. The structure of claim 1 wherein said detent means is a trip rod extending through a tube secured in an opening through said wall means.

6. The structure of claim 1 wherein said detent means includes a hook means which is movable into a notch means in said drop latch.

7. The structure of claim 3 wherein said releasable interconnecting means comprising a stile member on said wall member, paralleling said vertically-oriented stile when said window guard is in closed position.

8. The structure of claim 1 wherein said link is composed of material having a melting point of 135 degrees.

9. The structure of claim 1 wherein said another part of said window guard has access means for insertion of an element to return said drop latch to latching position.

* * * * *